US010801093B2

(12) United States Patent
Na et al.

(10) Patent No.: US 10,801,093 B2
(45) Date of Patent: Oct. 13, 2020

(54) BULK PALLADIUM-COPPER-PHOSPHORUS GLASSES BEARING SILVER, GOLD, AND IRON

(71) Applicant: GlassiMetal Technology, Inc., Pasadena, CA (US)

(72) Inventors: Jong Hyun Na, Pasadena, CA (US); Marios D. Demetriou, West Hollywood, CA (US); Maximilien Launey, Pasadena, CA (US); William L. Johnson, San Marino, CA (US)

(73) Assignee: GlassiMetal Technology, Inc., Pasadena, CA (US)

( * ) Notice: Subject to any disclaimer, the term of this patent is extended or adjusted under 35 U.S.C. 154(b) by 0 days.

(21) Appl. No.: 15/891,770

(22) Filed: Feb. 8, 2018

(65) Prior Publication Data

US 2018/0223404 A1 Aug. 9, 2018

Related U.S. Application Data

(60) Provisional application No. 62/456,483, filed on Feb. 8, 2017.

(51) Int. Cl.
*C22C 45/00* (2006.01)
*C22C 1/00* (2006.01)

(52) U.S. Cl.
CPC ..... *C22C 45/003* (2013.01); *C22C 1/002* (2013.01)

(58) Field of Classification Search
CPC ..... C22C 45/003
See application file for complete search history.

(56) References Cited

U.S. PATENT DOCUMENTS

| | | | |
|---|---|---|---|
| 4,175,950 | A | 11/1979 | Linares et al. |
| 4,696,731 | A | 9/1987 | Tenhover |
| 4,765,834 | A | 8/1988 | Ananthapadmanabhan et al. |
| 4,781,803 | A | 11/1988 | Harris et al. |
| 5,350,468 | A | 9/1994 | Masumoto et al. |
| 5,593,514 | A | 1/1997 | Giessen |
| 5,919,320 | A | 7/1999 | Agarwal |
| 6,695,936 | B2 | 2/2004 | Johnson |
| 6,709,536 | B1 | 3/2004 | Kim et al. |

(Continued)

FOREIGN PATENT DOCUMENTS

| | | | |
|---|---|---|---|
| CN | 101191184 | A | 6/2008 |
| EP | 3149215 | A2 | 4/2017 |

(Continued)

OTHER PUBLICATIONS

Shen, T., He, Y., & Schwarz, R. (1999). Bulk amorphous Pd—Ni—Fe—P alloys: Preparation and characterization. Journal of Materials Research, 14(5), 2107-2115. (Year: 1999).*

(Continued)

*Primary Examiner* — Keith D. Hendricks
*Assistant Examiner* — Joshua S Carpenter
(74) *Attorney, Agent, or Firm* — KPPB LLP

(57) ABSTRACT

Pd—Cu—P metallic glass-forming alloy compositions and metallic glasses comprising at least one of Ag, Au, and Fe are provided, wherein the alloys demonstrate improved glass forming ability, as compared to Pd—Cu—P alloys free of Ag, Au, and Fe, and are capable of forming metallic glass rods with diameters in excess of 3 mm, and in some embodiments 26 mm or larger.

18 Claims, 10 Drawing Sheets

(56) References Cited

U.S. PATENT DOCUMENTS

| | | | | |
|---|---|---|---|---|
| 6,730,415 | B2 | 5/2004 | Shibuya et al. | |
| 6,749,698 | B2 | 6/2004 | Shimizu et al. | |
| 7,540,929 | B2 * | 6/2009 | Demetriou | C22C 45/003 148/403 |
| 7,582,172 | B2 | 9/2009 | Schroers et al. | |
| 8,066,827 | B2 | 11/2011 | Demetriou et al. | |
| 8,361,250 | B2 | 1/2013 | Demetriou et al. | |
| 8,501,087 | B2 | 8/2013 | Peker et al. | |
| 9,119,447 | B2 | 9/2015 | Demetriou et al. | |
| 9,790,580 | B1 * | 10/2017 | Yurko | C22C 45/00 |
| 2006/0157164 | A1 | 7/2006 | Johnson et al. | |
| 2009/0236494 | A1 | 9/2009 | Hata et al. | |
| 2010/0322818 | A1 | 12/2010 | Bridgeman et al. | |
| 2011/0162795 | A1 | 7/2011 | Pham et al. | |
| 2013/0139931 | A1 | 6/2013 | Demetriou | |
| 2013/0306196 | A1 | 11/2013 | Prest et al. | |
| 2014/0009872 | A1 | 1/2014 | Prest et al. | |
| 2014/0096874 | A1 | 4/2014 | Weber et al. | |
| 2014/0202596 | A1 | 7/2014 | Na et al. | |
| 2014/0331915 | A1 | 11/2014 | Chaudhari | |
| 2015/0267286 | A1 | 9/2015 | Demetriou et al. | |
| 2015/0344999 | A1 | 12/2015 | Na et al. | |
| 2016/0340758 | A1 | 11/2016 | Na et al. | |
| 2017/0241003 | A1 | 8/2017 | Na et al. | |

FOREIGN PATENT DOCUMENTS

| | | | |
|---|---|---|---|
| EP | 3149215 | B1 | 12/2018 |
| HK | 1230251 | A | 12/2017 |
| JP | 3808354 | B2 | 8/2006 |
| WO | 2015148510 | A2 | 10/2015 |
| WO | 2017147088 | A1 | 8/2017 |

OTHER PUBLICATIONS

Liu et al. Formation and Thermal Stability of Pd-based Bulk Metallic Glasses. Journal of Non-Crystalline Solids. vol. 352, Issues 52-54, Dec. 15, 2006, pp. 5487-5491 (Year: 2006).*

International Preliminary Report on Patentability for International Application No. PCT/US2015/022254, Report dated Sep. 27, 2016, dated Oct. 6, 2016, 11 pgs.

International Search Report and Written Opinion for International Application No. PCT/US2015/022254, Search completed Jul. 21, 2015, dated Nov. 10, 2015, 17 pgs.

International Search Report and Written Opinion for International Application No. PCT/US2017/018754, Search completed Apr. 5, 2017. Action dated May 5, 2017, 11 pgs.

"ASTM E1820-15", Standard Test Method for Measurement of Fracture Toughness, ASTM International, West Conshohocken, PA, USA, 2015.

Basketter et al., "Nickel, Cobalt and Chromium in Consumer Products: a Role in Allergic Contact Dermatitis?", Contact Dermatitis, May 13, 1992, vol. 28, pp. 15-25.

Biggs T. et al., "The Hardening of Platinum Alloys for Potential Jewellery Application", Platinium Metals Review, Jan. 1, 2005, vol. 49, No. 1, XP009055328, ISSN: 0032-1400, DOI: 10.1595/147106705X24409, pp. 2-15.

Chabot et al., "Effect of silicon on trace element partitioning in iron-bearing metallic melts", Meteoritics & Planetary Science, May 27, 2010, vol. 45, No. 8., pp. 1243-1257.

Conner et al., "Shear bands and cracking of metallic glass plates in bending", Journal of Applied Physics, Jul. 15, 2003, vol. 94, No. 2, pp. 904-911.

Eisenbart, M. et al., "On the Abnormal Room Temperature Tarnishing of an 18 Carat Gold Bulk Metallic Glass Alloy", Journal of Alloys and Compounds, 2014, vol. 615, pp. S118-S122.

German, R. M. et al., "The colour of Gold-Silver-Copper alloys; Quantitative Mapping on the Ternary Diagram", Gold Bulletin, 1980, vol. 13, pp. 113-116.

Ho, C. Y. et al., "Thermal Conductivity of Ten Selected Binary Alloy System", CINDAS-TPRC Report 30, May 1975.

Hofmann, D. C. et al., "Designing metallic glass matrix composites with high toughness and tensile ductility," Nature, Feb. 28, 2008, vol. 451, pp. 1085-1089, DOI: 10.1038/nature06598.

Hunter, "Photoelectric Color Difference Meter", Journal of the Optical Society of America, Dec. 1958, vol. 48, No. 12, pp. 985-995.

Inoue et al., "Preparation and Thermal Stability of Bulk Amorphous Pd40Cu30Ni10P20 Alloy Cylinder of 72 mm in Diameter", Materials Transactions, JIM, 1997, vol. 38, pp. 179-183.

Inoue et al., "Developments and applications of bulk metallic glasses", Reviews on Advanced Materials Science, Feb. 28, 2008, vol. 18, pp. 1-9.

Lee et al., "Effect of a controlled volume fraction of dendritic phases on tensile and compressive ductility in La-based metallic glass matrix composites", Acta Materialia, vol. 52, Issue 14, Jun. 17, 2004, pp. 4121-4131.

Lewandowski, J. J. et al., "Intrinsic and extrinsic toughening of metallic glasses", Scripta Materialia, 2006, vol. 54, pp. 337-341.

Mozgovoy, S. et al., "Investigation of Mechanical, Corrosion, and Optical Properties of an 18 Carat Au—Cu—Si—Ag—Pd Metallic Glass", Intermetallics, Sep. 22, 2010, vol. 18, pp. 2289-2291.

Nishiyama et al., "New Pd-Based Glassy Alloys with High Glass Forming Ability", Journal of Alloys and Compounds, 2007, vol. 434-435, pp. 138-140.

Ritchie, R. O. et al., "On the Relationship between Critical Tensile Stress and Fracture Toughness in Mild Steel," Journal of the Mechanics and Physics of Solids, 1973, vol. 21, pp. 395-410.

Saotome, Yasunori et al., "Characteristic behavior ofPt-based metallic glass under rapid heating and its application to microforming", Materials Science and Engineering A, 2004, vols. 375-377, pp. 389-393.

Schroers et al., "Gold based bulk metallic glass", Applied Physics Letters, Aug. 3, 2005, vol. 87, 061912, 3 pgs.

Shiraishi et al., "An estimation of the reflectivity of gold-and platinum-group metals alloyed with copper", Journal of Materials Science, Feb. 4, 2014, vol. 49, No. 9, pp. 3462-3463.

Skriver et al., "Surface Energy and Work Function of Elemental Metals", Physical Review B, Sep. 15, 1992, vol. 46, No. 11, pp. 7157-7168.

Wu et al., "Bulk Metallic Glass Composites with Transformation-Mediated Work-Hardening and Ductility", Advanced Materials, Apr. 26, 2010, vol. 22, pp. 2270-2773.

Zachrisson et al., "Effect of Processing on Charpy impact toughness of metallic glass matrix composites", Journal of Materials Research, May 28, 2011, vol. 26, No. 10, pp. 1260-1268.

Zhang et al., "Formation of Bulk Pt—Pd—Ni—P Glassy Alloys", Journal of Non-Crystalline Solids, Jun. 21, 2006, vol. 352, pp. 3103-3108.

International Preliminary Report on Patentability for International Application PCT/US2017/018754, Report dated Aug. 28, 2018, dated Sep. 7, 2018, 09 Pgs.

* cited by examiner

BULK PALLADIUM-COPPER-PHOSPHORUS GLASSES BEARING SILVER, GOLD, AND IRON

CROSS-REFERENCE TO RELATED APPLICATIONS

The application claims priority to U.S. Provisional App. No. 62/456,483, filed Feb. 8, 2017, the disclosure of which is incorporated herein by reference.

FIELD OF THE INVENTION

The disclosure is directed to Pd—Cu—P alloys bearing at least one of Ag, Au, and Fe and capable of forming metallic glass samples with a critical rod diameter of at least 3 mm.

BACKGROUND OF THE INVENTION

Pd—Cu—P alloys bearing Ni are known to form glassy rods with diameters of up to 72 mm (A. Inoue, N. Nishiyama, H. Kimura, "Preparation and Thermal Stability of Bulk Amorphous $Pd_{40}Cu_{30}Ni_{10}P_{20}$ Alloy Cylinder of 72 mm in Diameter," Materials Transactions JIM Vol. 38, pp. 179-183 (1997), the disclosure of which is incorporated herein by reference in its entirety). Pd—Cu—P alloys bearing Pt are also known to form glassy rods with diameters of up to 30 mm (N. Nishiyama, K. Takenaka, T. Wada, H. Kimura, A. Inoue, "New Pd-Based Glassy Alloys with High Glass Forming Ability," Journal of Alloys and Compounds Vol. 434-435, pp. 138-140 (2007), the disclosure of which is incorporated herein by reference in its entirety). U.S. Pat. No. 7,540,929 entitled "Metallic Glass Alloys of Palladium, Cobalt, and Phosphorous," the disclosures of which is incorporated herein by reference in its entirety, also discloses ternary Pd—Cu—P alloys bearing Co capable of forming a bulk metallic glass.

SUMMARY OF THE INVENTION

The disclosure provides Pd—Cu—P metallic glass-forming alloys and metallic glasses comprising at least one of Ag, Au, and Fe as well as potentially other elements, where the alloys have a critical rod diameter of at least 3 mm.

In one embodiment, the disclosure is directed to an alloy capable of forming a metallic glass having a composition represented by the following formula (subscripts denote atomic percentages):

$$Pd_{(100-a-b-c-d-e)}Cu_aAg_bAu_cFe_dP_e$$

where:

a ranges from 5 to 55;

b is up to 25;

c is up to 20;

d is up to 15;

e ranges from 12.5 to 27.5;

wherein at least one of b, c, and d is at least 0.1;

wherein the critical rod diameter of the alloy is at least 3 mm.

In other embodiments, the critical rod diameter of the alloy is at least 5 mm.

In other embodiments, the critical rod diameter of the alloy is at least 6 mm.

In other embodiments, the critical rod diameter of the alloy is at least 7 mm.

In other embodiments, the critical rod diameter of the alloy is at least 8 mm.

In other embodiments, the critical rod diameter of the alloy is at least 10 mm.

In other embodiments, the critical rod diameter of the alloy is at least 12 mm.

In other embodiments, the critical rod diameter of the alloy is at least 15 mm.

In other embodiments, the critical rod diameter of the alloy is at least 20 mm.

In another embodiment, at least one of b, c, and d is at least 0.2.

In another embodiment, at least one of b, c, and d is at least 0.25.

In another embodiment, at least one of b, c, and d is at least 0.5.

In another embodiment, at least two of b, c, and d are at least 0.2 each.

In another embodiment, at least two of b, c, and d are at least 0.25 each.

In another embodiment, at least two of b, c, and d are at least 0.5 each.

In another embodiment, b and c are at least 0.1 each.

In another embodiment, b and d are at least 0.1 each.

In another embodiment, c and d are at least 0.1 each.

In another embodiment, b, c, and d are at least 0.1 each.

In another embodiment, e ranges from 15 to 25.

In another embodiment, e ranges from 17.5 to 22.5.

In another embodiment, the atomic concentration of Pd is at least 50.0 percent.

In another embodiment, the atomic concentration of Pd is between 50.0 and 55.0 percent.

In another embodiment, the atomic concentration of Pd is between 50.0 and 52.0 percent.

In another embodiment, a ranges from 10 to 50, b ranges from 0.1 to 25, c and d are 0, and e ranges from 15 to 25.

In another embodiment, a ranges from 10 to 50, c ranges from 0.1 to 15, b and d are 0, and e ranges from 15 to 25.

In another embodiment, a ranges from 10 to 50, d ranges from 0.1 to 10, b and c are 0, and e ranges from 15 to 25.

In another embodiment, a ranges from 10 to 50, b ranges from 0.1 to 20, c ranges from 0.1 to 15, d is 0, and e ranges from 15 to 25.

In another embodiment, a ranges from 10 to 50, b ranges from 0.1 to 20, d ranges from 0.1 to 10, c is 0, and e ranges from 15 to 25.

In another embodiment, a ranges from 10 to 50, c ranges from 0.1 to 15, d ranges from 0.1 to 10, b is 0, and e ranges from 15 to 25.

In another embodiment, the alloy comprises at least one of Ni, Pt, and Co as a partial substitution for Pd, each in an atomic concentration of less than 5 percent.

In another embodiment, the alloy comprises at least one of Ni, Pt, and Co as partial substitutions for Pd, each in an atomic concentration of less than 2 percent.

In another embodiment, the alloy comprises Ni as a partial substitution for Pd in an atomic concentration of less than 1 percent.

In another embodiment, the alloy comprises Ni as a partial substitution for Pd in an atomic concentration of less than 0.5 percent.

In another embodiment, the alloy comprises Ni as a partial substitution for Pd in an atomic concentration of less than 0.25 percent.

In another embodiment, the alloy comprises Pt as a partial substitution for Pd in an atomic concentration of less than 1 percent.

In another embodiment, the alloy comprises Pt as a partial substitution for Pd in an atomic concentration of less than 0.5 percent.

In another embodiment, the alloy comprises Pt as a partial substitution for Pd in an atomic concentration of less than 0.25 percent.

In another embodiment, the alloy comprises Co as a partial substitution for Pd in an atomic concentration of less than 1 percent.

In another embodiment, the alloy comprises Co as a partial substitution for Pd in an atomic concentration of less than 0.5 percent.

In another embodiment, the alloy comprises Co as a partial substitution for Pd in an atomic concentration of less than 0.25 percent.

In another embodiment, the alloy also comprises at least one of Ru, Rh and Ir as a partial substitution for Pd, each in an atomic concentration of less than 5 percent.

In another embodiment, the alloy also comprises at least one of B, Si, and Ge as a partial substitution for P, each in an atomic concentration of less than 3 percent.

In another embodiment, b ranges from 0.1 to 25, and c and d are 0.

In another embodiment, the disclosure is directed to an alloy capable of forming a metallic glass having a composition represented by the following formula (subscripts denote atomic percentages):

$$Pd_{(100-a-b-e)}Cu_aAg_bP_e$$

where:

a ranges from 5 to 55;

b ranges from 0.1 to 25;

e ranges from 12.5 to 27.5;

wherein the critical rod diameter of the alloy is at least 3 mm.

In another embodiment, a ranges from 10 to 50, b ranges from 0.1 to 20, and e ranges from 15 to 25.

In another embodiment, a ranges from 10 to 50, b ranges from 0.1 to 20, and e ranges from 15 to 25, and wherein the critical rod diameter of the alloy is at least 5 mm.

In another embodiment, a ranges from 15 to 45, b ranges from 1 to 15, and e ranges from 17.5 to 22.5.

In another embodiment, a ranges from 15 to 45, b ranges from 1 to 15, and e ranges from 17.5 to 22.5, and wherein the critical rod diameter of the alloy is at least 7 mm.

In another embodiment, a ranges from 20 to 40, b ranges from 2 to 12, and e ranges from 18.5 to 21.5.

In another embodiment, a ranges from 20 to 40, b ranges from 2 to 12, and e ranges from 18.5 to 21.5, and wherein the critical rod diameter of the alloy is at least 9 mm.

In another embodiment, b and d are 0, and c ranges from 0.1 to 20.

In another embodiment, the disclosure is directed to an alloy capable of forming a metallic glass having a composition represented by the following formula (subscripts denote atomic percentages):

$$Pd_{(100-a-c-e)}Cu_aAu_cP_e$$

where:

a ranges from 5 to 55;

c ranges from 0.1 to 20;

e ranges from 12.5 to 27.5;

wherein the critical rod diameter of the alloy is at least 3 mm.

In another embodiment, a ranges from 10 to 50, c ranges from 0.1 to 15, and e ranges from 15 to 25.

In another embodiment, a ranges from 10 to 50, c ranges from 0.1 to 15, and e ranges from 15 to 25, and wherein the critical rod diameter of the alloy is at least 5 mm.

In another embodiment, b and c are 0, and d ranges from 0.1 to 15.

In another embodiment, the disclosure is directed to an alloy capable of forming a metallic glass having a composition represented by the following formula (subscripts denote atomic percentages):

$$Pd_{(100-a-d-e)}Cu_aFe_dP_e$$

where:

a ranges from 5 to 55;

d ranges from 0.1 to 15;

e ranges from 12.5 to 27.5;

wherein the critical rod diameter of the alloy is at least 3 mm.

In another embodiment, a ranges from 10 to 50, d ranges from 0.1 to 10, and e ranges from 15 to 25.

In another embodiment, a ranges from 10 to 50, d ranges from 0.1 to 10, and e ranges from 15 to 25, and wherein the critical rod diameter of the alloy is at least 5 mm.

In another embodiment, b ranges from 0.1 to 25, c ranges from 0.1 to 20, and d is 0.

In another embodiment, the disclosure is directed to an alloy capable of forming a metallic glass having a composition represented by the following formula (subscripts denote atomic percentages):

$$Pd_{(100-a-b-c-e)}Cu_aAg_bAu_cP_e$$

where:

a ranges from 5 to 55;

b ranges from 0.1 to 25;

c ranges from 0.1 to 20;

e ranges from 12.5 to 27.5;

wherein the critical rod diameter of the alloy is at least 3 mm.

In another embodiment, a ranges from 10 to 50, b ranges from 0.1 to 20, c ranges from 0.1 to 15, and e ranges from 15 to 25.

In another embodiment, a ranges from 10 to 50, b ranges from 0.1 to 20, c ranges from 0.1 to 15, and e ranges from 15 to 25, and wherein the critical rod diameter of the alloy is at least 5 mm.

In another embodiment, b ranges from 0.1 to 25, c is 0, and d ranges from 0.1 to 15.

In another embodiment, the disclosure is directed to an alloy capable of forming a metallic glass having a composition represented by the following formula (subscripts denote atomic percentages):

$$Pd_{(100-a-b-d-e)}Cu_aAg_bFe_dP_e$$

where:

a ranges from 5 to 55;

b ranges from 0.1 to 25;

d ranges from 0.1 to 15;

e ranges from 12.5 to 27.5;

wherein the critical rod diameter of the alloy is at least 3 mm.

In another embodiment, a ranges from 10 to 50, b ranges from 0.1 to 20, d ranges from 0.1 to 10, and e ranges from 15 to 25.

In another embodiment, a ranges from 10 to 50, b ranges from 0.1 to 20, d ranges from 0.1 to 10, and e ranges from 15 to 25, and wherein the critical rod diameter of the alloy is at least 5 mm.

In another embodiment, a ranges from 20 to 45, b ranges from 0.5 to 10, d ranges from 0.5 to 7.5, and e ranges from 17.5 to 22.5.

In another embodiment, a ranges from 20 to 45, b ranges from 0.5 to 10, d ranges from 0.5 to 7.5, and e ranges from 17.5 to 22.5, and wherein the critical rod diameter of the alloy is at least 7 mm.

In another embodiment, a ranges from 30 to 40, b ranges from 1 to 7.5, d ranges from 0.75 to 5, and e ranges from 18 to 22.

In another embodiment, a ranges from 30 to 40, b ranges from 1 to 7.5, d ranges from 0.75 to 5, and e ranges from 18 to 22, and wherein the critical rod diameter of the alloy is at least 9 mm.

In another embodiment, b is 0, c ranges from 0.1 to 20, and d ranges from 0.1 to 15.

In another embodiment, the disclosure is directed to an alloy capable of forming a metallic glass having a composition represented by the following formula (subscripts denote atomic percentages):

$$Pd_{(100-a-c-d-e)}Cu_aAu_cFe_dP_e$$

where:

a ranges from 5 to 55;

c ranges from 0.1 to 20;

d ranges from 0.1 to 15;

e ranges from 12.5 to 27.5;

wherein the critical rod diameter of the alloy is at least 3 mm.

In another embodiment, a ranges from 10 to 50, c ranges from 0.1 to 15, d ranges from 0.1 to 10, and e ranges from 15 to 25.

In another embodiment, a ranges from 10 to 50, c ranges from 0.1 to 15, d ranges from 0.1 to 10, and e ranges from 15 to 25, and wherein the critical rod diameter of the alloy is at least 5 mm.

In yet another embodiment, the melt of the alloy is fluxed with a reducing agent prior to forming a metallic glass.

In yet another embodiment, the reducing agent is boron oxide.

In yet another embodiment, the temperature of the melt prior to quenching to form a metallic glass is at least 100° C. above the liquidus temperature of the alloy.

In yet another embodiment, the temperature of the melt prior to quenching to form a metallic glass is at least at the liquidus temperature of the alloy.

The disclosure is further directed to a metallic glass according to any of the above formulas and/or formed of any of the foregoing alloys.

The disclosure is also directed to an alloy or a metallic glass having compositions selected from a group consisting of: $Pd_{40}Cu_{37.5}Ag_{2.5}P_{20}$, $Pd_{40}Cu_{36}Ag_4P_{20}$, $Pd_{40}Cu_{35}Ag_5P_{20}$, $Pd_{40}Cu_{34}Ag_6P_{20}$, $Pd_{40}Cu_{32.5}Ag_{7.5}P_{20}$, $Pd_{40}Cu_{31}Ag_9P_{20}$, $Pd_{40}Cu_{29}Ag_{11}P_{20}$, $Pd_{40}Cu_{27}Ag_{13}P_{20}$, $Pd_{57}Cu_{18}Ag_5P_{20}$, $Pd_{55}Cu_{20}Ag_5P_{20}$, $Pd_{53}Cu_{22}Ag_5P_{20}$, $Pd_{51}Cu_{24}Ag_5P_{20}$, $Pd_{49}Cu_{26}Ag_5P_{20}$ $Pd_{48}Cu_{27}Ag_5P_{20}$, $Pd_{47}Cu_{28}Ag_5P_{20}$, $Pd_{45}Cu_{30}Ag_5P_{20}$, $Pd_{42}Cu_{33}Ag_5P_{20}$, $Pd_{38}Cu_{37}Ag_5P_{20}$, $Pd_{35}Cu_{40}Ag_5P_{20}$, $Pd_{49.8}Cu_{28.01}Ag_{5.19}P_{17}$, $Pd_{49.2}Cu_{27.68}Ag_{5.12}P_{18}$ $Pd_{48.6}Cu_{27.34}Ag_{5.06}P_{19}$, $Pd_{47.4}Cu_{26.66}Ag_{4.94}P_{21}$, $Pd_{46.8}Cu_{26.32}Ag_{4.88}P_{22}$, $Pd_{40}Cu_{37}Fe_{0.5}Ag_{2.5}P_{20}$, $Pd_{40}Cu_{36.5}Fe_1Ag_{2.5}P_{20}$, $Pd_{40}Cu_{35.5}Fe_2Ag_{2.5}P_{20}$, $Pd_{40}Cu_{34.5}Fe_3Ag_{2.5}P_{20}$, $Pd_{40}Cu_{33.5}Fe_4Ag_{2.5}P_{20}$, $Pd_{40}Cu_{35}Fe_5P_{20}$, $Pd_{48}Cu_{29}Au_3P_{20}$, $Pd_{35.5}Cu_{41}Fe_1Ag_{2.5}P_{20}$, $Pd_{36}Cu_{35}Fe_2Ag_7P_{20}$, $Pd_{35.5}Cu_{40}Fe_2Ag_{2.5}P_{20}$, and $Pd_{34.5}Cu_{41}Fe_2Ag_{2.5}P_{20}$.

Additional embodiments and features are set forth in part in the description that follows, and in part will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

DETAILED DISCLOSURE

Figure 1:
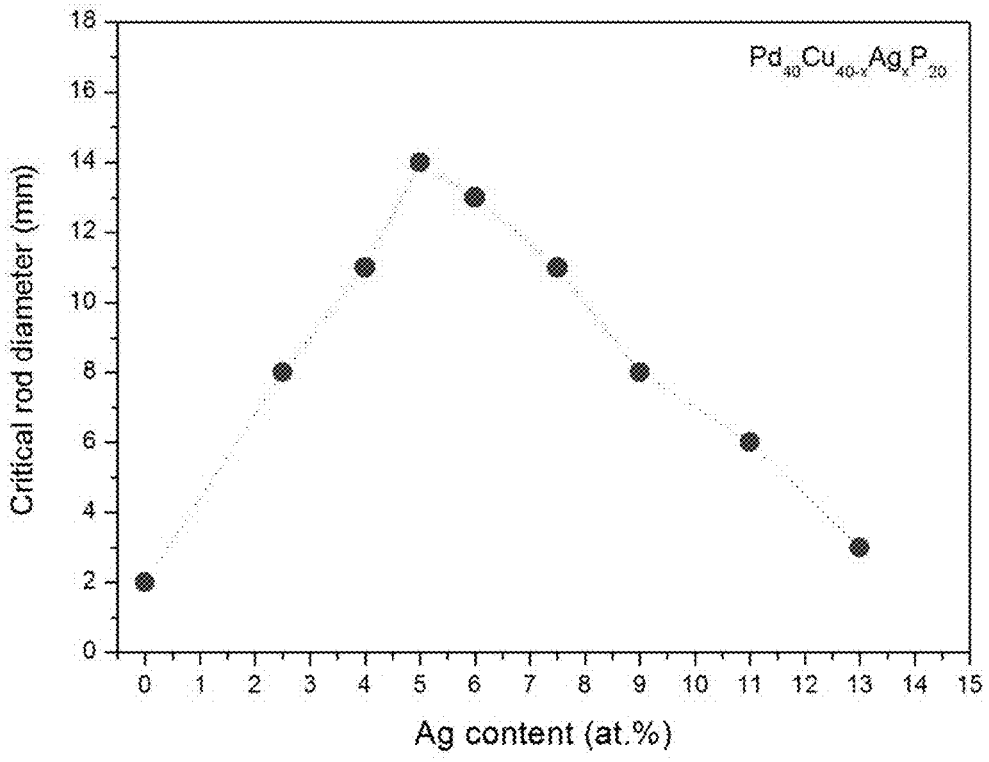
FIG. 1 provides a data plot showing the effect of increasing the atomic concentration of Ag at the expense of Cu according to the composition formula $Pd_{40}Cu_{40-x}Ag_xP_{20}$ on the glass-forming ability of the alloys.

The disclosure may be understood by reference to the following detailed description, taken in conjunction with the drawings as described below. It is noted that, for purposes of illustrative clarity, certain elements in various drawings may not be drawn to scale.

In accordance with the provided disclosure and drawings, Pd—Cu—P glass-forming alloys and metallic glasses bearing at least one of Ag, Au, and Fe are provided, where the at least one of Ag, Au, and Fe contributes to improve the glass-forming ability of the alloy in relation to a Pd—Cu—P alloy free of Ag, Au, and Fe.

In many embodiments of the disclosure, the glass-forming ability of each alloy is quantified by the "critical rod diameter," defined as the largest rod diameter in which the amorphous phase (i.e. the metallic glass) can be formed when processed by a method of water quenching a quartz tube having 0.5 mm thick walls containing a molten alloy.

Alternatively, the critical rod diameter can be defined via its "critical cooling rate", which, in turn, is the cooling rate required to avoid crystallization and form the amorphous phase of the alloy. In this framework, the lower is the critical cooling rate of an alloy, the larger is its critical rod diameter. More specifically, the critical cooling rate $R_c$ in K/s and critical rod diameter $d_c$ in mm are related via the following approximate empirical Equation:

$$R_c=1000/d_c^2 \quad (0)$$

Therefore, according to Equation (0), the critical cooling rate for an alloy having a critical rod diameter of about 1 mm is about $10^3$ K/s.

Generally, three categories are used in the art for describing the ability of a metal alloy to form glass (i.e. to bypass the stable crystal phase and form an amorphous phase). Metal alloys having critical cooling rates in excess of $10^{12}$ K/s are typically referred to as non-glass formers, as it is physically impossible to achieve such cooling rates over a meaningful thickness. Metal alloys having critical cooling rates in the range of $10^5$ to $10^{12}$ K/s are typically referred to as marginal glass formers, as they are able to form glass over thicknesses ranging from 1 to 100 micrometers according to Eq. (0). Metal alloys having critical cooling rates on the order of $10^3$ or less, and as low as 1 or 0.1 K/s, are typically referred to as bulk glass formers, as they are able to form glass over thicknesses ranging from 1 millimeter to several centimeters. The glass-forming ability of a metallic alloy is, to a very large extent, dependent on the composition of the alloy. The compositional ranges for alloys that are marginal glass formers are considerably broader than those that are bulk glass formers.

Furthermore, it should be noted in the context of this disclosure, that quartz is known to be a poor heat conductor that retards heat transfer. Hence, the cooling rate attained when water quenching the melt in 0.5-mm-thick wall quartz tubes of a given inner diameter would be relatively low, and specifically considerably lower than the cooling rate attained by copper mold casting of the melt in a cavity of the same diameter. Thus, the "critical rod diameter" determined by the quartz water quenching method would not be comparable to the "critical rod diameter" determined by copper mold casting. Generally, the "critical rod diameter" determined by the quartz water quenching method would be lower than the "critical rod diameter" determined by copper mold casting.

In many embodiments of this disclosure, an alloy being free of a certain element means that the concentration of that element in the alloy is consistent with the concentration of an incidental impurity. In the context of this disclosure, the concentration of a certain element in an alloy being 0 means that the concentration of that element is consistent with the concentration of an incidental impurity. In some embodiments, the concentration of an incidental impurity is less than 0.1 atomic percent. In still other embodiments compositions given by formulas of this disclosure explicitly anticipate impurities, such as those typically entrained in the commercial starting materials employed in the production of disclosed alloys, in a combined atomic concentration of up to 2%.

In various embodiments, the disclosure is directed to an alloy capable of forming a metallic glass having a composition represented by the following formula (subscripts denote atomic percentages):

$$Pd_{(100-a-b-c-d-e)}Cu_aAg_bAu_cFe_dP_e \quad (1)$$

where:

a ranges from 5 to 55, b is up to 25, c is up to 20, d is up to 15, e ranges from 12.5 to 27.5, and wherein at least one of b, c, and d is at least 0.1, and wherein the critical rod diameter of the alloy is at least 3 mm.

In other such embodiments, the critical rod diameter of the alloy capable of forming a metallic glass and having the composition represented by formula (1) is at least 5 mm. In other embodiments, the critical rod diameter of the alloy represented by formula (1) is at least 6 mm. In other embodiments, the critical rod diameter of the alloy represented by formula (1) is at least 7 mm. In other embodiments, the critical rod diameter of the alloy represented by formula (1) is at least 8 mm. In other embodiments, the critical rod diameter of the alloy represented by formula (1) is at least 10 mm. In other embodiments, the critical rod diameter of the alloy represented by formula (1) is at least 12 mm. In other embodiments, the critical rod diameter of the alloy represented by formula (1) is at least 15 mm. In yet other embodiments, the critical rod diameter of the alloy represented by formula (1) is at least 20 mm.

In another embodiment, the alloy capable of forming a metallic glass with the critical rod diameter of at least 3 mm has the composition represented by formula (1), wherein at least one of b, c, and d is at least 0.2. In another embodiment, the alloy has the composition represented by formula (1), wherein at least one of b, c, and d is at least 0.25. In another embodiment, the alloy has the composition represented by formula (1), wherein at least one of b, c, and d is at least 0.5.

In another embodiment, the alloy capable of forming a metallic glass with the critical rod diameter of at least 3 mm has the composition represented by formula (1), wherein at least two of b, c, and d are at least 0.2 each. In another embodiment, the alloy has the composition represented by formula (1), wherein at least two of b, c, and d are at least 0.25 each. In another embodiment, the alloy has the composition represented by formula (1), wherein at least two of b, c, and d are at least 0.5 each.

In another embodiment, the alloy capable of forming a metallic glass with the critical rod diameter of at least 3 mm has the composition represented by formula (1), wherein b and c are at least 0.1 each. In another embodiment, the alloy has the composition represented by formula (1), wherein b and d are at least 0.1 each. In another embodiment, the alloy has the composition represented by formula (1), wherein c and d are at least 0.1 each. In another embodiment, the alloy has the composition represented by formula (1), wherein b, c, and d are at least 0.1 each.

In another embodiment, the alloy capable of forming a metallic glass having the critical rod diameter of at least 3 mm has the composition represented by formula (1), wherein e ranges from 15 to 25. In another embodiment, the alloy has the composition represented by formula (1), wherein e ranges from 17.5 to 22.5.

In another embodiment, the alloy capable of forming a metallic glass having the critical rod diameter of at least 3 mm has the composition represented by formula (1), wherein the atomic concentration of Pd, i.e. (100-a-b-c-d-e), is at least 50 atomic percent. In another embodiment, the atomic concentration of Pd is between 50.0 and 55.0 atomic percent. In another embodiment, the atomic concentration of Pd is between 50.0 and 52.0 atomic percent.

In another embodiment, the alloy capable of forming a metallic glass having the critical rod diameter of at least 3 mm has the composition represented by formula (1), wherein a ranges from 10 to 50, b ranges from 0.1 to 20, c and d are 0, and e ranges from 15 to 25. In another embodiment, a ranges from 10 to 50, c ranges from 0.1 to 15, b and d are 0, and e ranges from 15 to 25. In another embodiment, a ranges from 10 to 50, d ranges from 0.1 to 10 b and c are 0, and e ranges from 15 to 25. In another embodiment, a ranges from 10 to 50, b ranges from 0.1 to 20, c ranges from 0.1 to 15, d is 0, and e ranges from 15 to 25. In another embodiment, a ranges from 10 to 50, b ranges from 0.1 to 20, d ranges from 0.1 to 10, c is 0, and e ranges from 15 to 25. In another embodiment, a ranges from 10 to 50, c ranges from 0.1 to 15, d ranges from 0.1 to 10, b is 0, and e ranges from 15 to 25.

In another embodiment, the alloy capable of forming a metallic glass having the critical rod diameter of at least 3 mm has the composition represented by formula (1), wherein the alloy additionally comprises at least one of Ni, Pt, and Co as a partial substitution for Pd, each in an atomic concentration of less than 5 percent. In another embodiment, the alloy comprises at least one of Ni, Pt, and Co as a partial substitution for Pd, each in an atomic concentration of less than 2 percent. In another embodiment, the alloy comprises Ni as a partial substitution for Pd in an atomic concentration of less than 1 percent. In another embodiment, the alloy comprises Ni as a partial substitution for Pd in an atomic concentration of less than 0.5 percent. In another embodiment, the alloy comprises Ni as a partial substitution for Pd in an atomic concentration of less than 0.25 percent. In another embodiment, the alloy comprises Pt as a partial substitution for Pd in an atomic concentration of less than 1 percent. In another embodiment, the alloy comprises Pt as a partial substitution for Pd in an atomic concentration of less than 0.5 percent. In another embodiment, the alloy comprises Pt as a partial substitution for Pd in an atomic concentration of less than 0.25 percent. In another embodiment, the alloy comprises Co as a partial substitution for Pd in an atomic concentration of less than 1 percent. In another embodiment, the alloy comprises Co as a partial substitution for Pd in an atomic concentration of less than 0.5 percent. In another embodiment, the alloy comprises Co as a partial substitution for Pd in an atomic concentration of less than 0.25 percent. In another embodiment, the alloy also comprises at least one of Ru, Rh and Ir as a partial substitution for Pd, each in an atomic concentration of up to 5 percent. In another embodiment, the alloy also comprises at least one of B, Si, and Ge as a partial substitution for P, each in an atomic concentration of up to 3 percent. It is also stated here that the compositions given by formulas of this disclosure explicitly anticipate impurities, such as those typically entrained in the commercial starting materials employed in the production of disclosed alloys, in a combined atomic concentration of up to 2%.

Description of Ag-Bearing Pd—Cu—P Alloys and Metallic Glass Compositions

In some embodiments, the disclosure is directed to Pd—Cu—P alloys and metallic glasses that bear Ag. In one embodiment, the disclosure is directed to an alloy capable of forming a metallic glass having a composition represented by the following formula (subscripts denote atomic percentages):

$$Pd_{(100-a-b-e)}Cu_aAg_bP_e \quad (2)$$

where:

a ranges from 5 to 55;

b ranges from 0.1 to 25;

e ranges from 12.5 to 27.5;

wherein the critical rod diameter of the alloy is at least 3 mm.

In another embodiment, the alloy capable of forming a metallic glass having the critical rod diameter of at least 3 mm has the composition represented by formula (2), wherein a ranges from 10 to 50, b ranges from 0.1 to 20, and e ranges from 15 to 25. In another embodiment, the alloy capable of forming a metallic glass having the critical rod diameter of at least 5 mm has the composition represented by formula (2), wherein a ranges from 10 to 50, b ranges from 0.1 to 20, and e ranges from 15 to 25. In another embodiment, the alloy capable of forming a metallic glass having the critical rod diameter of at least 3 mm has the composition represented by formula (2), wherein a ranges from 15 to 45, b ranges from 1 to 15, and e ranges from 17.5 to 22.5. In another embodiment, the alloy capable of forming a metallic glass having the critical rod diameter of at least 7 mm has the composition represented by formula (2), wherein a ranges from 15 to 45, b ranges from 1 to 15, and e ranges from 17.5 to 22.5. In another embodiment, the alloy capable of forming a metallic glass having the critical rod diameter of at least 3 mm has the composition represented by formula (2), wherein a ranges from 20 to 40, b ranges from 2 to 12, and e ranges from 18.5 to 21.5. In another embodiment, the alloy capable of forming a metallic glass having the critical rod diameter of at least 9 mm has the composition represented by formula (2), wherein a ranges from 20 to 40, b ranges from 2 to 12, and e ranges from 18.5 to 21.5.

Specific embodiments of metallic glasses formed of Pd—Cu—P alloys comprising Ag where the atomic concentration of Ag is varied at the expense of Cu according to the formula $Pd_{40}Cu_{40-x}Ag_xP_{20}$ (3) are presented in Table 1. In these alloys, the atomic concentration of Ag increases from 0 to 13 percent as the atomic concentration of Cu decreases from 40 to 27 percent. In such embodiments, the atomic concentration of Pd is constant at 40 percent while the atomic concentration of P is constant at 20 percent. The critical rod diameters of the example alloys are also listed in Table 1. FIG. 1 provides a data plot showing the effect of increasing the atomic concentration of Ag at the expense of Cu according to the composition formula (3) on the glass-forming ability of the alloys.

TABLE 1

Sample metallic glasses demonstrating the effect of increasing the Ag atomic concentration at the expense of Cu according to the formula $Pd_{40}Cu_{40-x}Ag_xP_{20}$ (3) on the glass forming ability of the alloys

| Example | Composition | Critical Rod Diameter [mm] |
|---|---|---|
| 1 | $Pd_{40}Cu_{40}P_{20}$ | 2 |
| 2 | $Pd_{40}Cu_{37.5}Ag_{2.5}P_{20}$ | 8 |
| 3 | $Pd_{40}Cu_{36}Ag_4P_{20}$ | 11 |
| 4 | $Pd_{40}Cu_{35}Ag_5P_{20}$ | 14 |

TABLE 1-continued

Sample metallic glasses demonstrating the effect of increasing the Ag atomic concentration at the expense of Cu according to the formula $Pd_{40}Cu_{40-x}Ag_xP_{20}$ (3) on the glass forming ability of the alloys

| Example | Composition | Critical Rod Diameter [mm] |
|---|---|---|
| 5 | $Pd_{40}Cu_{34}Ag_6P_{20}$ | 13 |
| 6 | $Pd_{40}Cu_{32.5}Ag_{7.5}P_{20}$ | 11 |
| 7 | $Pd_{40}Cu_{31}Ag_9P_{20}$ | 8 |
| 8 | $Pd_{40}Cu_{29}Ag_{11}P_{20}$ | 6 |
| 9 | $Pd_{40}Cu_{27}Ag_{13}P_{20}$ | 3 |

As shown in Table 1 and FIG. 1, substituting Ag for Cu according to formula (3) improves glass-forming ability of the alloy. Specifically, the critical rod diameter is shown to increase from 2 mm for the Ag-free ternary alloy $Pd_{40}Cu_{40}P_{20}$ (Example 1), to a peak value of 14 mm for alloy $Pd_{40}Cu_{35}Ag_5P_{20}$ comprising 5 atomic percent Ag (Example 4), and back to 3 mm for the alloy $Pd_{40}Cu_{27}Ag_{13}P_{20}$ comprising 13 atomic percent Ag (Example 9). As seen in Table 1 and FIG. 1, by including 5 atomic percent of Ag in $Pd_{40}Cu_{40-x}Ag_xP_{20}$, the critical rod diameter increases from 2 mm to 14 mm, i.e. by a factor of 7.

Figure 2:
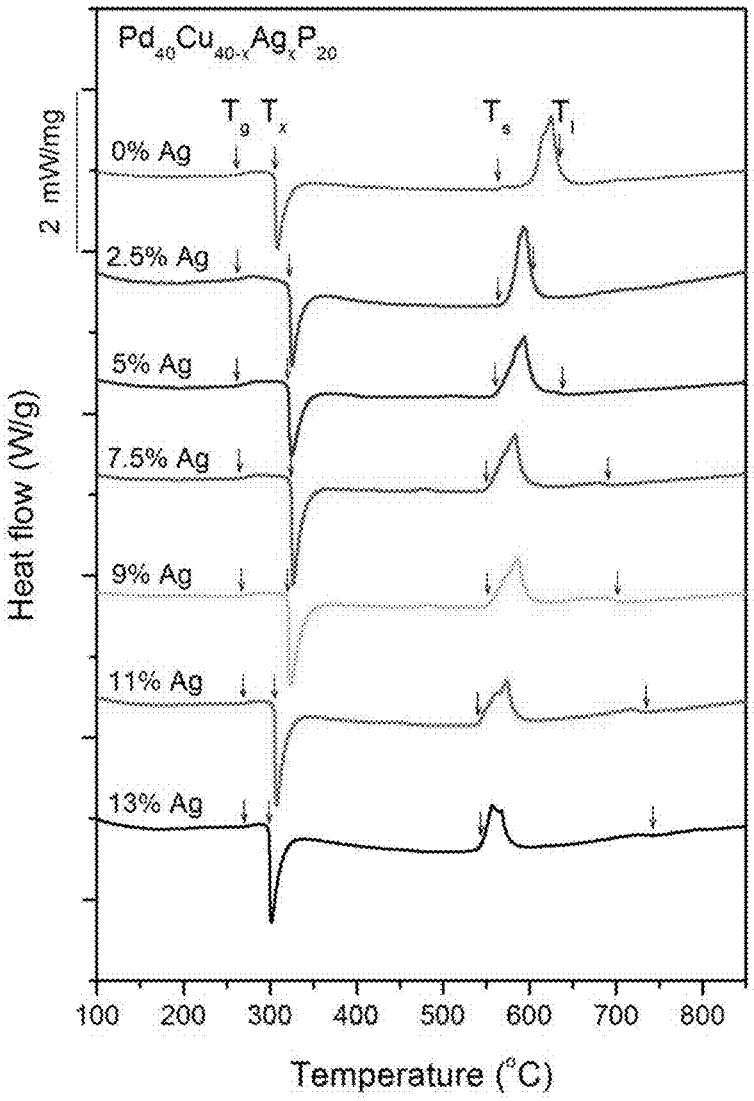
FIG. 2 provides calorimetry scans for sample metallic glasses having composition represented by formula $Pd_{40}Cu_{40-x}Ag_xP_{20}$ in accordance with embodiments of the disclosure. The glass transition temperature $T_g$, crystallization temperature $T_x$, solidus temperature $T_s$, and liquidus temperature $T_l$ are indicated by arrows.

FIG. 2 provides calorimetry scans for sample metallic glasses having the composition represented by formula (3) in accordance with embodiments of the disclosure. The glass transition temperature $T_g$, crystallization temperature $T_x$, solidus temperature $T_s$, and liquidus temperature $T_l$ are indicated by arrows in FIG. 2, and are listed in Table 2. The difference between crystallization and glass-transition temperatures ($\Delta T_x = T_x - T_g$) for each sample is also listed in Table 2. As seen in FIG. 2 and Table 2, substituting Cu with Ag, increases $T_g$ roughly monotonically from 261.3° C. for the ternary alloy $Pd_{40}Cu_{40}P_{20}$ (Example 1) to 270.7° C. for alloy $Pd_{40}Cu_{27}Ag_{13}P_{20}$ (Example 13). The same substitution decreases $T_l$ slightly from 634.9° C. for the ternary alloy $Pd_{40}Cu_{40}P_{20}$ (Example 1) to 604.4° C. for alloy $Pd_{40}Cu_{32.5}Ag_{2.5}P_{20}$ (Example 2) but then increases it roughly monotonically to 742.2° C. for alloy $Pd_{40}Cu_{22}Ag_{13}P_{20}$ (Example 9).

TABLE 2

Sample metallic glasses demonstrating the effect of increasing the Ag atomic concentration at the expense of Cu according to the formula $Pd_{40}Cu_{40-x}Ag_xP_{20}$ (3) on the glass-transition, crystallization, solidus, and liquidus temperatures

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 1 | $Pd_{40}Cu_{40}P_{20}$ | 261.3 | 305.7 | 44.4 | 563.3 | 634.9 |
| 2 | $Pd_{40}Cu_{37.5}Ag_{2.5}P_{20}$ | 262.5 | 322.5 | 60.0 | 563.5 | 604.4 |
| 4 | $Pd_{40}Cu_{35}Ag_5P_{20}$ | 261.4 | 320.6 | 59.2 | 561.4 | 638.3 |
| 6 | $Pd_{40}Cu_{32.5}Ag_{7.5}P_{20}$ | 264.8 | 323.7 | 58.9 | 550.6 | 691.4 |
| 7 | $Pd_{40}Cu_{31}Ag_9P_{20}$ | 267.2 | 320.0 | 52.8 | 551.8 | 701.6 |
| 8 | $Pd_{40}Cu_{29}Ag_{11}P_{20}$ | 268.8 | 305.1 | 46.3 | 540.6 | 735.1 |
| 9 | $Pd_{40}Cu_{27}Ag_{13}P_{20}$ | 270.7 | 298.9 | 28.2 | 544.1 | 742.2 |

Figure 3:
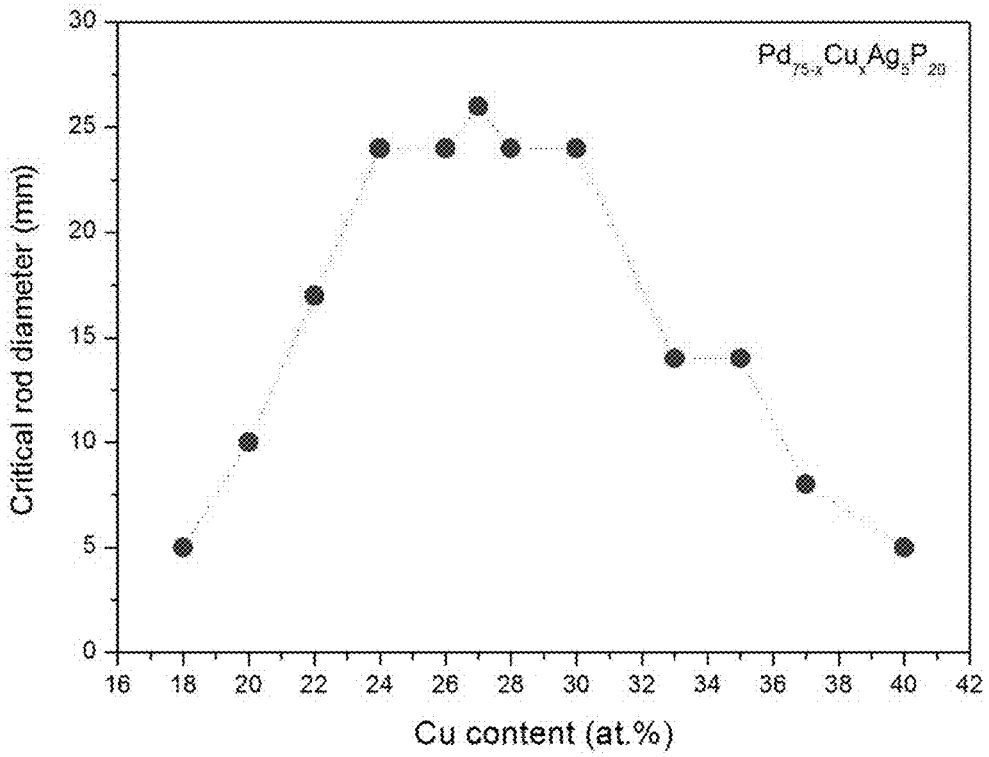
FIG. 3 provides a data plot showing the effect of increasing the atomic concentration of Cu at the expense of Pd according to the composition formula $Pd_{75-x}Cu_xAg_5P_{20}$ on the glass-forming ability of the alloys.

Specific embodiments of metallic glasses formed of Pd—Cu—P alloys comprising Ag where the atomic concentration of Cu is varied at the expense of Pd according to the formula $Pd_{75-x}Cu_xAg_5P_{20}$ (4) are presented in Table 3. In these alloys, the atomic concentration of Cu increases from 18 to 40 percent as the atomic concentration of Pd decreases from 57 to 35 percent. The atomic concentration of Ag is constant at 5 percent while the atomic concentration of P is constant at 20 percent. The critical rod diameters of the example alloys are also listed in Table 3. FIG. 3 provides a data plot showing the effect of increasing the atomic concentration of Cu at the expense of Pd according to the composition formula (4) on the glass-forming ability of the alloys.

TABLE 3

Sample metallic glasses demonstrating the effect of increasing the Cu atomic concentration at the expense of Pd according to the formula $Pd_{75-x}Cu_xAg_5P_{20}$ (4) on the glass forming ability

| Example | Composition | Critical Rod Diameter [mm] |
|---|---|---|
| 10 | $Pd_{57}Cu_{18}Ag_5P_{20}$ | 5 |
| 11 | $Pd_{55}Cu_{20}Ag_5P_{20}$ | 10 |
| 12 | $Pd_{53}Cu_{22}Ag_5P_{20}$ | 17 |
| 13 | $Pd_{51}Cu_{24}Ag_5P_{20}$ | 24 |
| 14 | $Pd_{49}Cu_{26}Ag_5P_{20}$ | 24 |
| 15 | $Pd_{48}Cu_{27}Ag_5P_{20}$ | 26 |
| 16 | $Pd_{47}Cu_{28}Ag_5P_{20}$ | 24 |
| 17 | $Pd_{45}Cu_{30}Ag_5P_{20}$ | 24 |
| 18 | $Pd_{42}Cu_{33}Ag_5P_{20}$ | 14 |
| 4 | $Pd_{40}Cu_{35}Ag_5P_{20}$ | 14 |
| 19 | $Pd_{38}Cu_{37}Ag_5P_{20}$ | 7 |
| 20 | $Pd_{35}Cu_{40}Ag_5P_{20}$ | 5 |

As shown in Table 3 and FIG. 3, the critical rod diameter increases from 5 mm for alloy $Pd_{57}Cu_{18}Ag_5P_{20}$ comprising 18 atomic percent Cu (Example 10), to a peak value of 26 mm for alloy $Pd_{48}Cu_{27}Ag_5P_{20}$ comprising 27 atomic percent Cu (Example 15), and then drops back to 5 mm for alloy $Pd_{35}Cu_{40}Ag_5P_{20}$ comprising 40 atomic percent Cu (Example 20). Hence, by properly adjusting the Cu—Pd ratio in $Pd_{40}Cu_{40-x}Ag_xP_{20}$, the critical rod diameter can vary from 5 mm to 26 mm, i.e. by a factor of more than 5.

Figure 4:
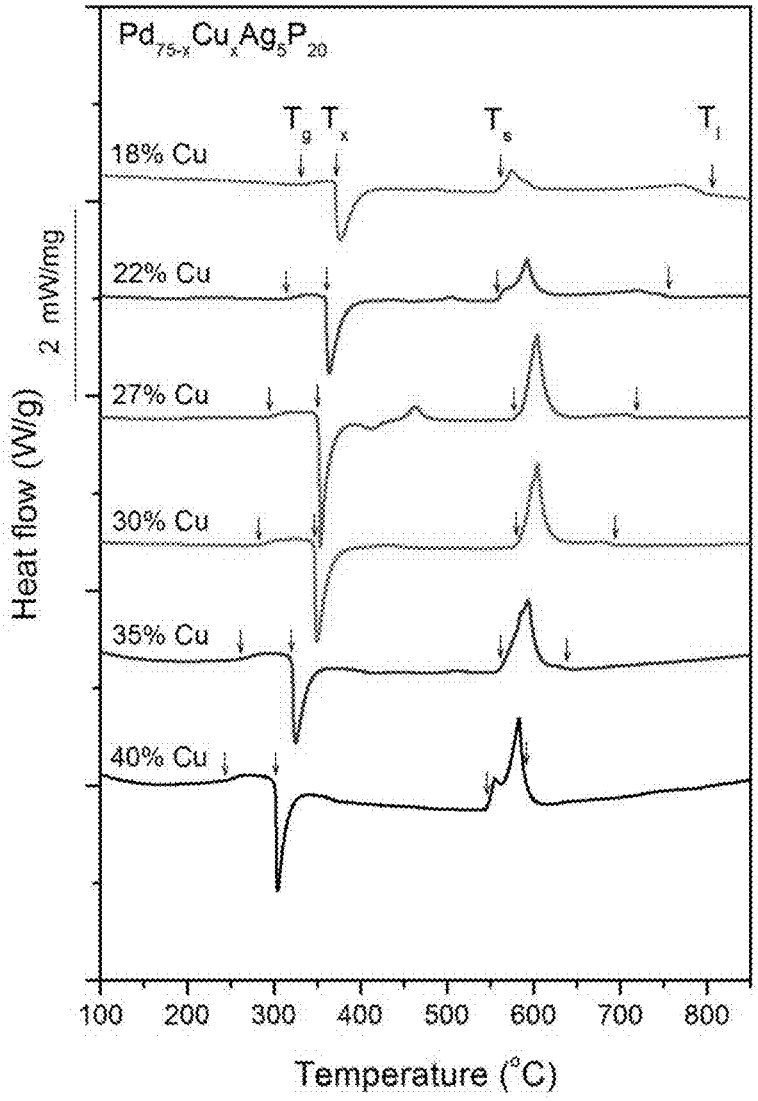
FIG. 4 provides calorimetry scans for sample metallic glasses having composition represented by formula $Pd_{75-x}Cu_xAg_5P_{20}$ in accordance with embodiments of the disclosure. The glass transition temperature $T_g$, crystallization temperature $T_x$, solidus temperature $T_s$, and liquidus temperature $T_l$ are indicated by arrows.

FIG. 4 provides calorimetry scans for sample metallic glasses having the composition represented by formula (4) in accordance with embodiments of the disclosure. The glass transition temperature $T_g$, crystallization temperature $T_x$, solidus temperature $T_s$, and liquidus temperature $T_l$ are indicated by arrows in FIG. 4, and are listed in Table 4. The difference between crystallization and glass-transition temperatures ($\Delta T_x = T_x - T_g$) for each sample is also listed in Table 4. As seen in FIG. 4 and Table 4, substituting Pd with Cu, decreases $T_g$ roughly monotonically from 331.6° C. for alloy $Pd_{57}Cu_{18}Ag_5P_{20}$ (Example 10) to 243.8° C. for alloy $Pd_{35}Cu_{40}Ag_5P_{20}$ (Example 20). The same substitution decreases $T_l$ roughly monotonically from 807.1° C. for alloy $Pd_{57}Cu_{18}Ag_5P_{20}$ (Example 10) to 590.7° C. for alloy $Pd_{35}Cu_{40}Ag_5P_{20}$ (Example 20).

TABLE 4

Sample metallic glasses demonstrating the effect of increasing the Cu atomic concentration at the expense of Pd according to the formula $Pd_{75-x}Cu_xAg_5P_{20}$ (4) on the glass-transition, crystallization, solidus, and liquidus temperatures

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 10 | $Pd_{57}Cu_{18}Ag_5P_{20}$ | 331.6 | 370.8 | 39.2 | 560.5 | 807.1 |
| 12 | $Pd_{53}Cu_{22}Ag_5P_{20}$ | 314.8 | 360.1 | 45.3 | 557.8 | 756.6 |
| 15 | $Pd_{48}Cu_{27}Ag_5P_{20}$ | 295.1 | 350.7 | 55.6 | 576.2 | 718.5 |
| 17 | $Pd_{45}Cu_{30}Ag_5P_{20}$ | 282.5 | 346.5 | 64.0 | 580.0 | 694.4 |
| 4 | $Pd_{40}Cu_{35}Ag_5P_{20}$ | 261.4 | 320.6 | 59.2 | 561.4 | 638.3 |
| 20 | $Pd_{35}Cu_{40}Ag_5P_{20}$ | 243.8 | 301.7 | 57.9 | 546.4 | 590.7 |

Figure 5:
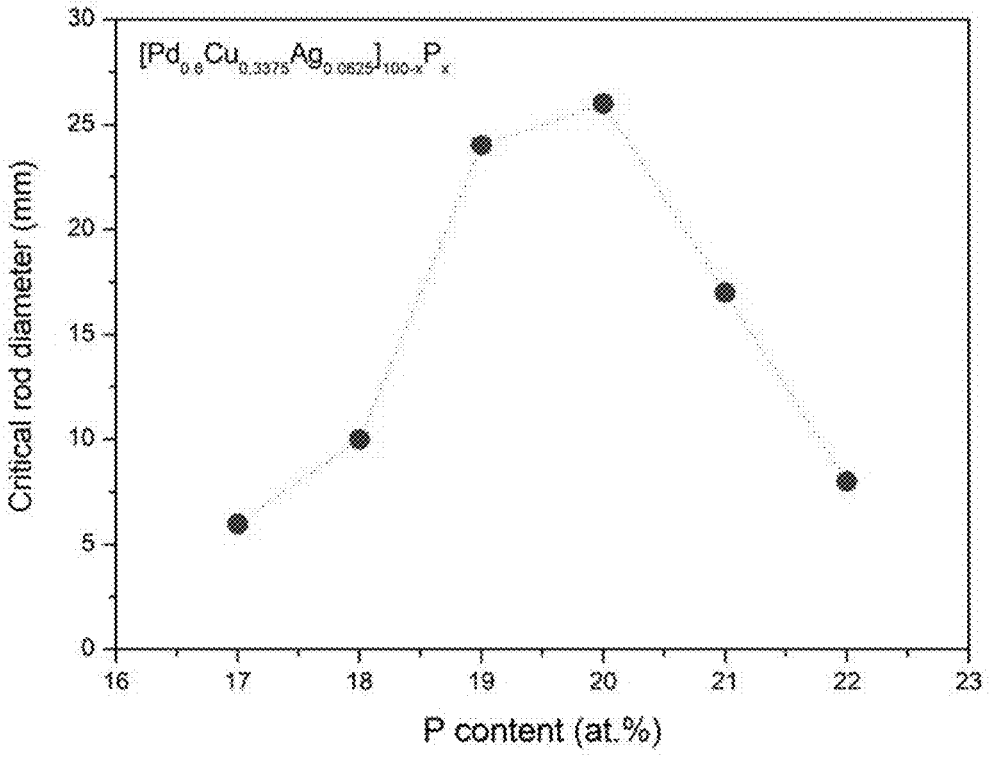
FIG. 5 provides a data plot showing the effect of increasing the atomic concentration of metalloid P at the expense of metals Pd, Cu, and Ag according to the composition formula $[Pd_{0.6}Cu_{0.34}Ag_{0.06}]_{100-x}P_x$ on the glass-forming ability of the alloys.

Specific embodiments of metallic glasses formed of Pd—Cu—P alloys comprising Ag where the atomic concentration of metalloid P is varied at the expense of metals Pd, Cu, and Ag according to the formula $[Pd_{0.6}Cu_{0.3375}Ag_{0.0625}]_{100-x}P_x$ (5) are presented in Table 5. In these alloys, the atomic concentration of P increases from 17 to 22 percent as the atomic concentration of Pd decreases from 49.8 to 46.8 percent, the atomic concentration of Cu decreases from 28.01 to 26.32 percent, while the atomic concentration of Ag decreases from 5.19 to 4.88 percent. The critical rod diameters of the example alloys are also listed in Table 5. FIG. 5 provides a data plot showing the effect of increasing the atomic concentration of metalloid P at the expense of metals Pd, Cu, and Ag according to the composition formula (5) on the glass-forming ability of the alloys.

TABLE 5

Sample metallic glasses demonstrating the effect of increasing the atomic concentration of metalloid P at the expense of metals Pd, Cu, and Ag according to the formula $[Pd_{0.6}Cu_{0.3375}Ag_{0.0625}]_{100-x}P_x$ (5) on the glass forming ability

| Example | Composition | Critical Rod Diameter [mm] |
|---|---|---|
| 21 | $Pd_{49.8}Cu_{28.01}Ag_{5.19}P_{17}$ | 6 |
| 22 | $Pd_{49.2}Cu_{27.68}Ag_{5.12}P_8$ | 10 |
| 23 | $Pd_{48.6}Cu_{27.34}Ag_{5.06}P_{19}$ | 24 |
| 15 | $Pd_{48}Cu_{27}Ag_5P_{20}$ | 26 |
| 24 | $Pd_{47.4}Cu_{26.66}Ag_{4.94}P_{21}$ | 17 |
| 25 | $Pd_{46.8}Cu_{26.32}Ag_{4.88}P_{22}$ | 8 |

As shown in Table 5 and FIG. 5, the critical rod diameter increases from 6 mm for alloy $Pd_{49.8}Cu_{28.01}Ag_{5.19}P_{17}$ comprising 17 atomic percent P (Example 21), to a peak value of 26 mm for alloy $Pd_{48}Cu_{27}Ag_5P_{20}$ comprising 20 atomic percent P (Example 15), and then drops back to 8 mm for alloy $Pd_{46.8}Cu_{26.32}Ag_{4.88}P_{22}$ comprising 22 atomic percent P (Example 25). Hence, by properly adjusting the P-metals ratio in $[Pd_{0.6}Cu_{0.34}Ag_{0.06}]_{100-x}P_x$, the critical rod diameter can vary from 6 mm to 26 mm, i.e. by a factor of 4.

Figure 6:
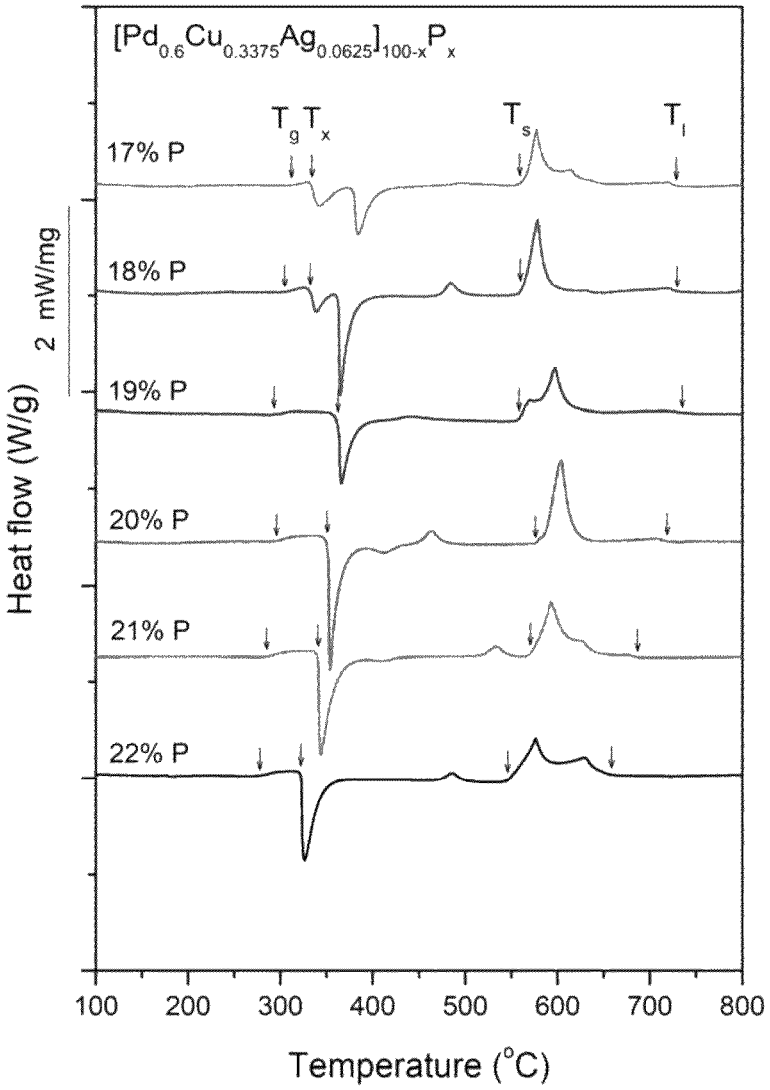
FIG. 6 provides calorimetry scans for sample metallic glasses having composition represented by formula $[Pd_{0.6}Cu_{0.34}Ag_{0.06}]_{100-x}P_x$ in accordance with embodiments of the disclosure. The glass transition temperature $T_g$, crystallization temperature $T_x$, solidus temperature $T_s$, and liquidus temperature $T_l$ are indicated by arrows.

FIG. 6 provides calorimetry scans for sample metallic glasses having the composition represented by formula (5) in accordance with embodiments of the disclosure. The glass transition temperature $T_g$, crystallization temperature $T_x$, solidus temperature $T_s$, and liquidus temperature $T_l$ are indicated by arrows in FIG. 6, and are listed in Table 6. The difference between crystallization and glass-transition temperatures ($\Delta T_x = T_x - T_g$) for each sample is also listed in Table 6. As seen in FIG. 6 and Table 6, substituting Pd, Cu, and Ag with P, decreases $T_g$ roughly monotonically from 311.7° C. for alloy $Pd_{49.8}Cu_{28.01}Ag_{5.19}P_{17}$ (Example 21) to 277.2° C. for alloy $Pd_{46.8}Cu_{26.32}Ag_{4.88}P_{22}$ (Example 25). The same substitution increases $T_l$ roughly monotonically from 728.8° C. for alloy $Pd_{49.8}Cu_{28.01}Ag_{5.19}P_{17}$ (Example 21) to 658.7° C. for alloy $Pd_{46.8}Cu_{26.32}Ag_{4.88}P_{22}$ (Example 25).

TABLE 6

Sample metallic glasses demonstrating the effect of increasing the atomic concentration of metalloid P at the expense of metals Pd, Cu, and Ag according to the formula $[Pd_{0.6}Cu_{0.34}Ag_{0.06}]_{100-x}P_x$ (5) on the glass-transition, crystallization, solidus, and liquidus temperatures

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 21 | $Pd_{49.8}Cu_{28.01}Ag_{5.19}P_{17}$ | 311.7 | 333.3 | 21.6 | 558.7 | 728.8 |
| 22 | $Pd_{49.2}Cu_{27.68}Ag_{5.12}P_{18}$ | 305.4 | 331.9 | 26.5 | 560.0 | 729.8 |
| 23 | $Pd_{48.6}Cu_{27.34}Ag_{5.06}P_{19}$ | 293.2 | 362.6 | 59.4 | 558.1 | 735.5 |
| 15 | $Pd_{48}Cu_{27}Ag_5P_{20}$ | 295.1 | 350.7 | 55.6 | 576.2 | 718.5 |
| 24 | $Pd_{47.4}Cu_{26.66}Ag_{4.94}P_{21}$ | 284.6 | 340.5 | 55.9 | 571.0 | 686.7 |
| 25 | $Pd_{46.8}Cu_{26.32}Ag_{4.88}P_{22}$ | 277.2 | 322.2 | 45.0 | 546.0 | 658.7 |

Figure 7:
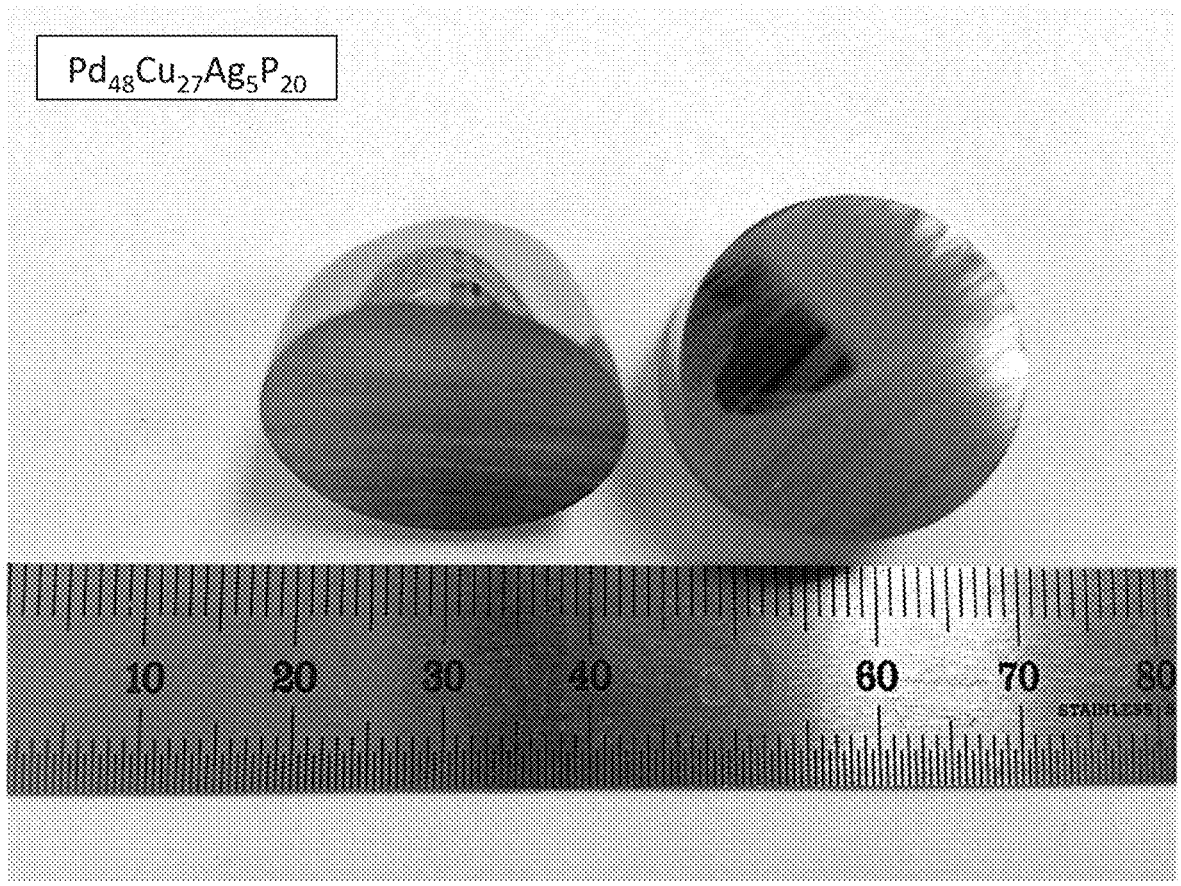
FIG. 7 provides an image of a 24 mm diameter metallic glass rod with composition $Pd_{48}Cu_{27}Ag_5P_{20}$ (Example 15).
Figure 8:
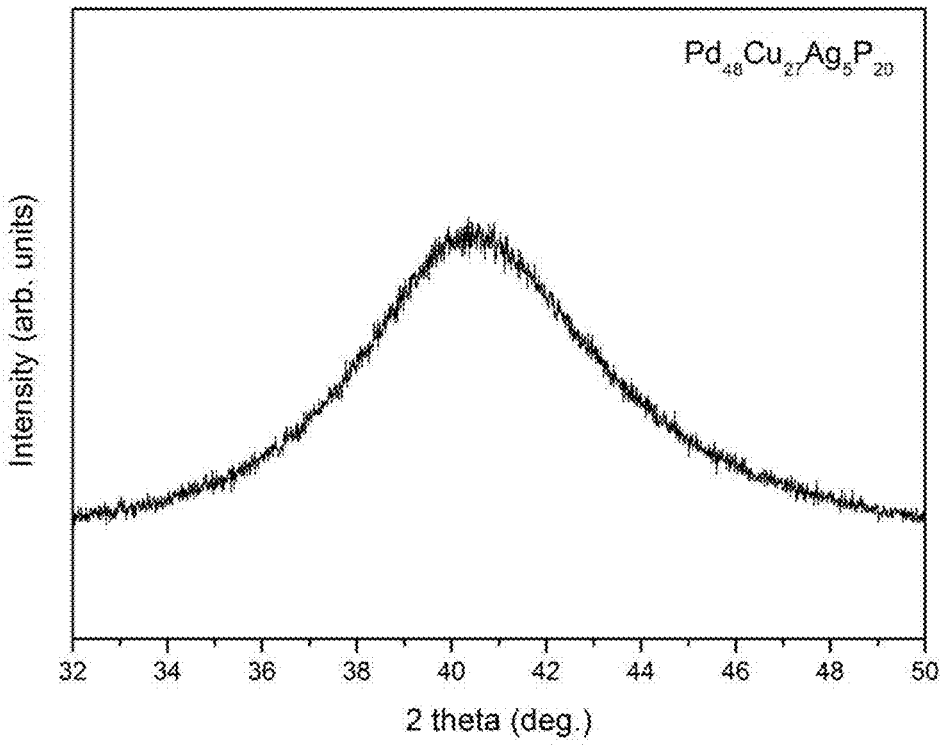
FIG. 8 provides an x-ray diffractogram verifying the amorphous structure of a 24 mm diameter metallic glass rod with composition $Pd_{48}Cu_{27}Ag_5P_{20}$ (Example 15).

As shown in Tables 3 and 5, alloy $Pd_{48}Cu_{27}Ag_5P_{20}$ (Example 15) has the highest glass-forming ability among Pd—Cu—Ag—P alloys, demonstrating a critical rod diameter of 26 mm. FIG. 7 provides an image of a 24 mm diameter metallic glass rod with composition $Pd_{48}Cu_{27}Ag_5P_{20}$ (Example 15). FIG. 8 provides an x-ray diffractogram verifying the amorphous structure of the 24 mm diameter metallic glass rod with composition $Pd_{48}Cu_{27}Ag_5P_{20}$ (Example 15).

Description of Ag- and Fe-Bearing Pd—Cu—P Alloys and Metallic Glass Compositions In some embodiments, the disclosure is directed to Pd—Cu—P alloys and metallic glasses that bear Ag and Fe. In one embodiment, the disclosure is directed to an alloy capable of forming a metallic glass having a composition represented by the following formula (subscripts denote atomic percentages):

$$Pd_{(100-a-b-d-e)}Cu_aAg_bFe_dP_e \quad (6)$$

where:

a ranges from 5 to 55;

b ranges from 0.1 to 25;

d ranges from 0.1 to 15;

e ranges from 12.5 to 27.5;

wherein the critical rod diameter of the alloy is at least 3 mm.

In another embodiment, the alloy capable of forming a metallic glass having the critical rod diameter of at least 3 mm has the composition represented by formula (6), wherein a ranges from 10 to 50, b ranges from 0.1 to 20, d ranges from 0.1 to 10, and e ranges from 15 to 25. In another embodiment, the alloy capable of forming a metallic glass having the critical rod diameter of at least 5 mm has the composition represented by formula (6), wherein a ranges from 10 to 50, b ranges from 0.1 to 20, d ranges from 0.1 to 10, and e ranges from 15 to 25. In another embodiment, the alloy capable of forming a metallic glass having the critical rod diameter of at least 3 mm has the composition represented by formula (6), wherein a ranges from 20 to 45, b ranges from 0.5 to 10, d ranges from 0.5 to 7.5, and e ranges from 17.5 to 22.5. In another embodiment, the alloy capable of forming a metallic glass having the critical rod diameter of at least 7 mm has the composition represented by formula (6), wherein a ranges from 20 to 45, b ranges from 0.5 to 10, d ranges from 0.5 to 7.5, and e ranges from 17.5 to 22.5. In another embodiment, the alloy capable of forming a metallic glass having the critical rod diameter of at least 3 mm has the composition represented by formula (6), wherein a ranges from 30 to 40, b ranges from 1 to 7.5, d ranges from 0.75 to 5, and e ranges from 18 to 22. In another embodiment, the alloy capable of forming a metallic glass having the critical rod diameter of at least 9 mm has the composition represented by formula (6), wherein a ranges from 30 to 40, b ranges from 1 to 7.5, d ranges from 0.75 to 5, and e ranges from 18 to 22.

Figure 9:
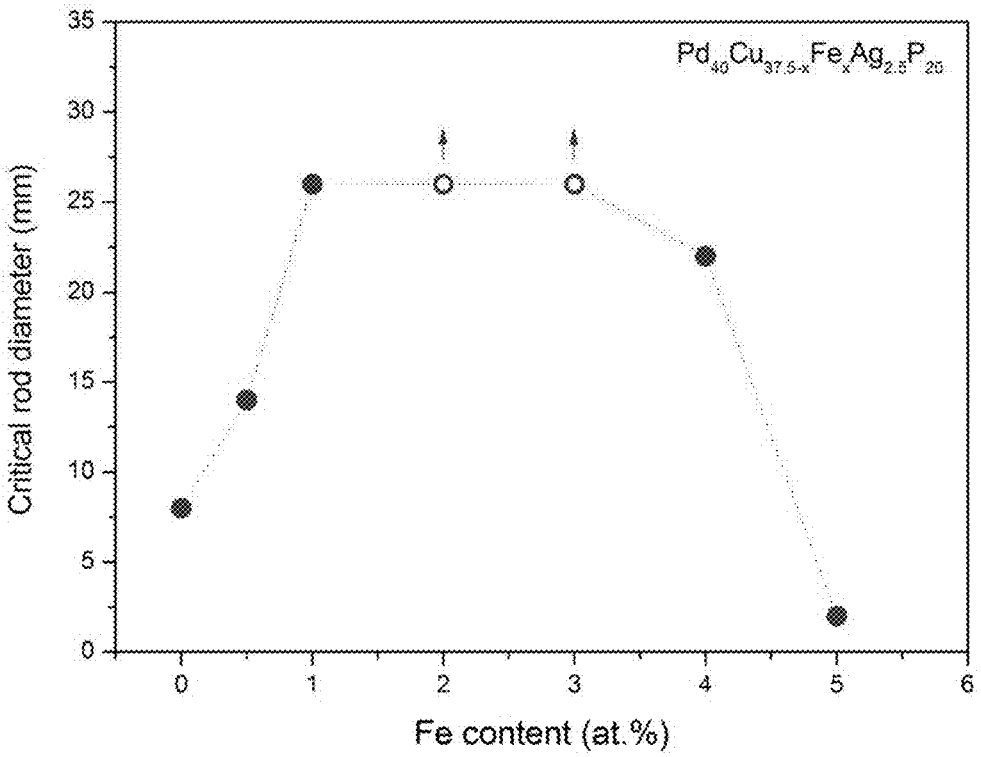
FIG. 9 provides a data plot showing the effect of increasing the atomic concentration of Fe at the expense of Cu according to the composition formula $Pd_{40}Cu_{37.5-x}Fe_xAg_{2.5}P_{20}$ on the glass-forming ability of the alloys. The solid symbols designate an actual measured value of the critical rod diameter, while open symbols with arrows indicate that the actual critical rod diameter exceeds the value designated by the symbol.

Specific embodiments of metallic glasses formed of Pd—Cu—P alloys comprising Ag and Fe where the atomic concentration of Fe is varied at the expense of Cu according to the formula $Pd_{40}Cu_{37.5-x}Fe_xAg_{2.5}P_{20}$ (7) are presented in Table 7. In these alloys, the atomic concentration of Fe increases from 0 to 5 percent as the atomic concentration of Cu decreases from 37.5 to 32.5 percent. The atomic concentration of Pd is constant at 40 percent, the atomic concentration of Ag is constant at 2.5 percent, while the atomic concentration of P is constant at 20 percent. The critical rod diameters of the example alloys are also listed in Table 1. FIG. 9 provides a data plot showing the effect of increasing the atomic concentration of Fe at the expense of Cu according to the composition formula (7) on the glass-forming ability of the alloys. The solid symbols designate an actual measured value of the critical rod diameter, while open symbols with arrows indicate that the actual critical rod diameter exceeds the value designated by the symbol.

TABLE 7

Sample metallic glasses demonstrating the effect of increasing the Fe atomic concentration at the expense of Cu according to the formula $Pd_{40}Cu_{37.5-x}Fe_xAg_{2.5}P_{20}$ (7) on the glass forming ability

| Example | Composition | Critical Rod Diameter [mm] |
|---|---|---|
| 2 | $Pd_{40}Cu_{37.5}Ag_{2.5}P_{20}$ | 8 |
| 26 | $Pd_{40}Cu_{37}Fe_{0.5}Ag_{2.5}P_{20}$ | 14 |
| 27 | $Pd_{40}Cu_{36.5}Fe_1Ag_{2.5}P_{20}$ | 26 |
| 28 | $Pd_{40}Cu_{35.5}Fe_2Ag_{2.5}P_{20}$ | >26 |
| 29 | $Pd_{40}Cu_{34.5}Fe_3Ag_{2.5}P_{20}$ | >26 |
| 30 | $Pd_{40}Cu_{33.5}Fe_4Ag_{2.5}P_{20}$ | 22 |
| 31 | $Pd_{40}Cu_{32.5}Fe_5Ag_{2.5}P_{20}$ | 2 |

As shown in Table 7 and FIG. 9, substituting Fe for Cu according to formula (7) improves glass-forming ability of the alloy. Specifically, it is shown that the critical rod diameter increases sharply from 8 mm for the Fe-free quaternary alloy $Pd_{40}Cu_{37.5}Ag_{2.5}P_{200}$ (Example 2) to peak values that exceed 26 mm for alloys $Pd_{40}Cu_{35.5}Fe_2Ag_{2.5}P_{20}$ (Example 28) and $Pd_{40}Cu_{34.5}Fe_3Ag_{2.5}P_{20}$ (Example 29), comprising 2 and 3 atomic percent Fe respectively, and decreases precipitously to 2 mm for alloy $Pd_{40}Cu_{32.5}Fe_5Ag_{2.5}P_{20}$ (Example 31) comprising 5 atomic percent Fe. (Note: the exact values of the critical rod diameters in excess of 26 mm were not evaluated, as it was technically difficult to evaluate a critical rod diameter exceeding 26 mm). Furthermore, as seen in Table 7 and FIG. 9, inclusion of just 1 atomic percent of Fe into formula (7) increases the critical rod diameter of the alloy from 8 mm to greater than 26 mm, i.e. by a factor of greater than 3. Furthermore, increasing atomic concentration of Fe by 1 additional atomic percent, dramatically decreases the critical rod diameter from 22 mm to 2 mm, i.e. by a factor of 11.

Figure 10:
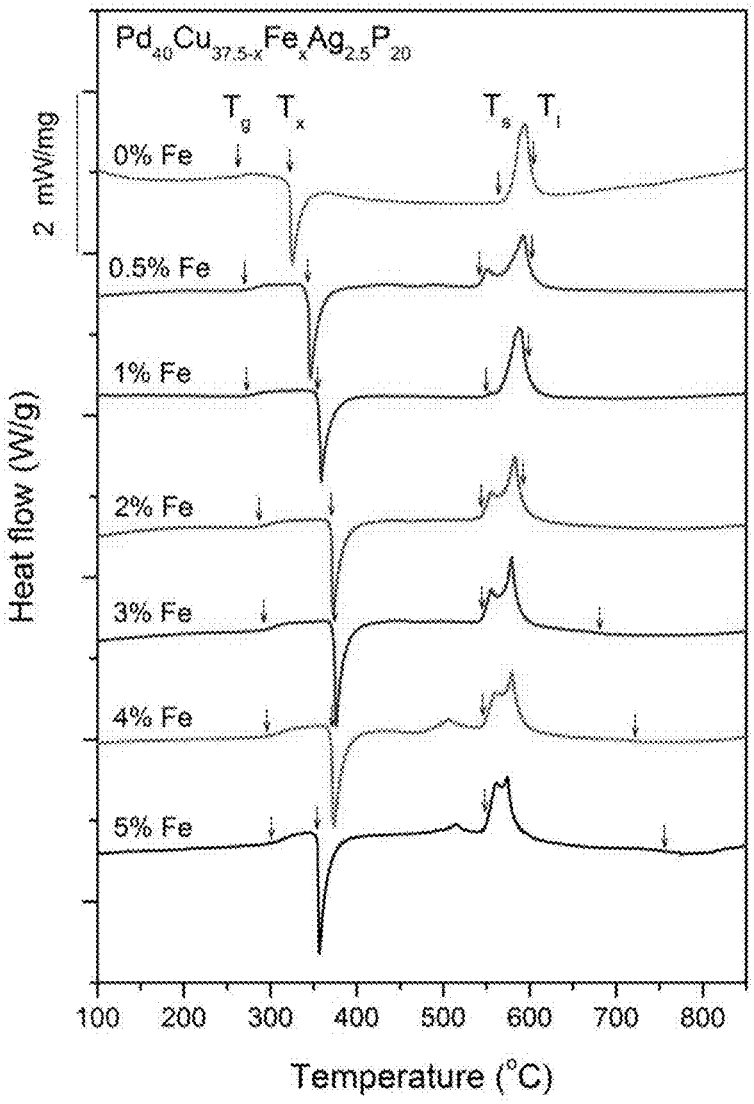
FIG. 10 provides calorimetry scans for sample metallic glasses having composition represented by formula $Pd_{40}Cu_{37.5-x}Fe_xAg_{2.5}P_{20}$ in accordance with embodiments of the disclosure. The glass transition temperature $T_g$, crystallization temperature $T_x$, solidus temperature $T_s$, and liquidus temperature $T_l$ are indicated by arrows.

FIG. 10 provides calorimetry scans for sample metallic glasses having the composition represented by formula (7) in accordance with embodiments of the disclosure. The glass transition temperature $T_g$, crystallization temperature $T_x$, solidus temperature $T_s$, and liquidus temperature $T_i$ are indicated by arrows in FIG. 10, and are listed in Table 8. The difference between crystallization and glass-transition temperatures ($\Delta T_x = T_x - T_g$) for each sample is also listed in Table 8. As seen in FIG. 10 and Table 8, substituting Cu with Fe, increases $T_g$ roughly monotonically from 262.5° C. for the quaternary alloy $Pd_{40}Cu_{37.5}Ag_{2.5}P_{20}$ (Example 2) to 301.1° C. for alloy $Pd_{40}Cu_{32.5}Fe_5Ag_{2.5}P_{20}$ (Example 31). The same substitution decreases $T_1$ from 604.4° C. for the quaternary alloy $Pd_{40}Cu_{37.5}Ag_{2.5}P_{20}$ (Example 2) to a minimum of 592.5° C. for alloy $Pd_{40}Cu_{35.5}Fe_2Ag_{2.5}P_{20}$ (Example 28), and then increases it back to 755.8° C. for alloy $Pd_{40}Cu_{32.5}Fe_5Ag_{2.5}P_{20}$ (Example 31).

TABLE 8

Sample metallic glasses demonstrating the effect of increasing the Fe atomic concentration at the expense of Cu according to the formula $Pd_{40}Cu_{37.5-x}Ag_{2.5}Fe_xP_{20}$ (7) on the glass-transition, crystallization, solidus, and liquidus temperatures

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 2 | $Pd_{40}Cu_{37.5}Ag_{2.5}P_{20}$ | 262.5 | 322.5 | 60.0 | 563.5 | 604.4 |
| 26 | $Pd_{40}Cu_{37}Fe_{0.5}Ag_{2.5}P_{20}$ | 269.9 | 343.9 | 74.0 | 541.8 | 602.6 |
| 27 | $Pd_{40}Cu_{36.5}Fe_1Ag_{2.5}P_{20}$ | 272.3 | 355.2 | 82.9 | 548.9 | 599.2 |
| 28 | $Pd_{40}Cu_{35.5}Fe_2Ag_{2.5}P_{20}$ | 286.8 | 370.7 | 83.9 | 544.2 | 592.5 |
| 29 | $Pd_{40}Cu_{34.5}Fe_3Ag_{2.5}P_{20}$ | 292.6 | 373.2 | 80.6 | 544.8 | 680.7 |
| 30 | $Pd_{40}Cu_{33.5}Fe_4Ag_{2.5}P_{20}$ | 296.2 | 370.7 | 74.5 | 546.6 | 722.6 |
| 31 | $Pd_{40}Cu_{32.5}Fe_5Ag_{2.5}P_{20}$ | 301.1 | 353.7 | 52.6 | 548.4 | 755.8 |

Other Alloys According to Embodiments of the Disclosure

Other alloys according to embodiments of the disclosure are listed in Table 9, along with the corresponding critical rod diameter.

TABLE 9

Other sample metallic glass according to embodiments of the disclosure.

| Example | Composition | Critical Rod Diameter [mm] |
|---|---|---|
| 32 | $Pd_{40}Cu_{35}Fe_5P_{20}$ | 4 |
| 33 | $Pd_{48}Cu_{29}Au_3P_{20}$ | >7 |
| 34 | $Pd_{35.5}Cu_{41}Fe_1Ag_{2.5}P_{20}$ | 14 |
| 35 | $Pd_{36}Cu_{35}Fe_2Ag_7P_{20}$ | >10 |
| 36 | $Pd_{35.5}Cu_{40}Fe_2Ag_{2.5}P_{20}$ | >15 |
| 37 | $Pd_{34.5}Cu_{41}Fe_2Ag_{2.5}P_{20}$ | >15 |

Description of Method of Producing the Alloy Ingots of the Sample Alloys

The method for producing the alloy ingots of the sample alloys involves inductive melting of the appropriate amounts of elemental constituents in a quartz tube under inert atmosphere. The purity levels of the constituent elements were as follows: Pd 99.95%, Cu 99.99%, Ag 99.95%, Au 99.99%, Fe 99.95%, and P 99.9999%.

The melting crucible may alternatively be a ceramic such as alumina or zirconia, graphite, sintered crystalline silica, or a water-cooled hearth made of copper or silver. In some embodiments, P can be incorporated in the alloy as a pre-alloyed compound formed with at least one of the other elements, like for example, as a Pd—P or a Cu—P compound.

Description of Method of Fluxing the Ingots of the Sample Alloys

Optionally, prior to producing a metallic glass article, the alloyed ingots may be fluxed with a reducing agent. In one embodiment, the reducing agent can be dehydrated boron oxide ($B_2O_3$). A particular method for fluxing the alloys of the disclosure involves melting the ingots and $B_2O_3$ in an inert crucible under inert atmosphere at a temperature in the range of 750 and 900° C., bringing the alloy melt in contact with the $B_2O_3$ melt and allowing the two melts to interact for about 1000 s, and subsequently quenching in a bath of room temperature water. In one embodiment the inert crucible is made of quartz, while in another embodiment the inert crucible comprises a ceramic. In some embodiments, the melt and $B_2O_3$ are allowed to interact for at least 500 seconds prior to quenching, and in other embodiments for at least 2000 seconds. In some embodiments, the melt and $B_2O_3$ are allowed to interact at a temperature of at least 700° C., and in other embodiments between 800 and 1200° C. In yet other embodiments, the step of producing the metallic glass rod may be performed simultaneously with the fluxing step, where the water-quenched sample at the completion of the fluxing step represents the metallic glass rod.

Prior to producing the metallic glass rods, the metallic glass rods of the sample alloys have been fluxed. The method for fluxing the alloyed ingots of the sample alloys involves melting the alloyed ingots and dehydrated $B_2O_3$ in a quartz tube under inert atmosphere, bringing the alloy melt in contact with the $B_2O_3$ melt and allowing the two melts to interact at 900° C. for about 1000 s, and subsequently quenching in a bath of room temperature water.

Description of Method of Producing Metallic Glass Rods of the Sample Alloys

The method for producing metallic glass rods of the sample alloys from the fluxed alloy ingots involves remelting the fluxed alloy ingots in quartz tubes having 0.5 mm thick walls in a furnace at 850° C. under high purity argon and rapidly quenching in a room-temperature water bath.

In some embodiments, the melt temperature prior to quenching is between 700 and 1200° C., while in other embodiments it is between 700 and 950° C., and yet in other embodiments between 700 and 800° C. In some embodiments, the bath could be ice water or oil. In other embodiments, metallic glass articles can be formed by injecting or pouring the molten alloy into a metal mold. In some embodiments, the mold can be made of copper, brass, or steel, among other materials.

Test Methodology for Assessing Glass-Forming Ability by Tube Quenching

The glass-forming ability of the alloys were assessed by determining the maximum rod diameter in which the amorphous phase of the alloy (i.e. the metallic glass phase) could be formed when processed by the method of water-quenching a quartz tube containing the alloy melt, as described above. X-ray diffraction with Cu-Kα radiation was performed to verify the amorphous structure of the quenched rods.

Test Methodology for Differential Scanning Calorimetry

Differential scanning calorimetry was performed on sample metallic glasses at a scan rate of 20 K/min to determine the glass-transition, crystallization, solidus, and liquidus temperatures of sample metallic glasses.

The alloys and metallic glasses described herein can be valuable in the fabrication of electronic devices. An electronic device herein can refer to any electronic device known in the art. For example, it can be a telephone, such as a mobile phone, and a landline phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

DOCTRINE OF EQUIVALENTS

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

What is claimed is:

1. An alloy capable of forming a metallic glass characterized by a critical rod diameter and consisting of a composition represented by the following formula wherein subscripts denote atomic percentages:

$$Pd_{100-a-b-c-d-e}Cu_aAg_bAu_cFe_dP_e$$

where:

a ranges from 5 to 55;

b is up to 25;

c is up to 20;

d is up to 15;

e ranges from 12.5 to 27.5;

wherein at least one of b, c, and d is at least 0.1;

wherein the critical rod diameter of the alloy is at least 3 mm.

2. The alloy of claim 1, wherein at least one of b, c, and d is at least 0.2 atomic percent each.

3. The alloy of claim 1, wherein at least two of b, c, and d are at least 0.2 atomic percent each.

4. The alloy of claim 1, wherein b and c are at least 0.1 atomic percent each.

5. The alloy of claim 1, wherein b and d are at least 0.1 atomic percent each.

6. The alloy of claim 1, wherein c and d are at least 0.1 atomic percent each.

7. The alloy of claim 1, wherein b, c, and d are at least 0.1 atomic percent each.

8. The alloy of claim 1, wherein the atomic concentration of Pd is at least 50 percent.

9. The alloy of claim 1, wherein b ranges from 0.1 to 25 atomic percent, and c and d are 0.

10. The alloy of claim 1, wherein b and d are 0, and c ranges from 0.1 to 20 atomic percent.

11. The alloy of claim 1, wherein b and c are 0, and d ranges from 0.1 to 15 atomic percent.

12. The alloy of claim 1, wherein b ranges from 0.1 to 25 atomic percent, c ranges from 0.1 to 20 atomic percent, and d is 0.

13. The alloy of claim 1, wherein b ranges from 0.1 to 25 atomic percent, c is 0, and d ranges from 0.1 to 15 atomic percent.

14. The alloy of claim 1, wherein b is 0, c ranges from 0.1 to 20 atomic percent, and d ranges from 0.1 to 15 atomic percent.

15. The alloy of claim 1, wherein a ranges from 10 to 50 atomic percent, b ranges from 0.1 to 20 atomic percent, c is 0, d ranges from 0.1 to 10 atomic percent, e ranges from 15 to 25 atomic percent, and the critical rod diameter of the alloy is at least 5 mm.

16. The alloy of claim 1, wherein a ranges from 20 to 45 atomic percent, b ranges from 0.5 to 10 atomic percent, c is 0, d ranges from 0.5 to 7.5 atomic percent, e ranges from 17.5 to 22.5 atomic percent, and the critical rod diameter of the alloy is at least 7 mm.

17. The alloy of claim 1, wherein a ranges from 30 to 40 atomic percent, b ranges from 1 to 7.5 atomic percent, c is 0, d ranges from 0.75 to 5 atomic percent, e ranges from 18 to 22 atomic percent, and the critical rod diameter of the alloy is at least 9 mm.

18. An alloy capable of forming a metallic glass characterized by a critical rod diameter and consisting of Cu having an atomic concentration of from 5 to 55%, P having an atomic concentration of from 12.5 to 27.5%, Ag having an atomic concentration of up to 25%, Au having an atomic concentration of up to 20%, Fe having an atomic concentration of up to 15%, Ru, Rh, and Ir having an atomic concentration of up to 5%, B, Si, and Ge having an atomic concentration of up to 3%, and a balance of Pd;

wherein the atomic concentration of at least one of Ag, Au and Fe is at least 0.1%; and wherein the critical rod diameter of the alloy is at least 3 mm.

* * * * *